United States Patent [19]

Edamura

[11] Patent Number: 4,780,588

[45] Date of Patent: Oct. 25, 1988

[54] MICROWAVE OVEN HAVING A PLURALITY OF STORED COOKING PROGRAMS

[75] Inventor: Kaoru Edamura, Nara, Japan

[73] Assignee: Sharp Kabushiki Kaisha, Osaka, Japan

[21] Appl. No.: 112,511

[22] Filed: Oct. 26, 1987

[30] Foreign Application Priority Data

Oct. 24, 1986 [JP] Japan ..... 61-254169

[51] Int. Cl.[4] ..... H05B 6/68

[52] U.S. Cl. ..... 219/10.55 B; 219/10.55 E; 219/492; 219/506; 99/325; 235/462

[58] Field of Search ..... 219/10.55 B, 10.55 R, 219/10.55 E, 506, 492; 235/473, 462, 375; 99/325–328

[56] References Cited

U.S. PATENT DOCUMENTS

| | | | |
|---|---|---|---|
| 4,323,773 | 4/1982 | Carpenter | 219/10.55 R X |
| 4,339,646 | 7/1982 | Doi et al. | 219/10.55 B |
| 4,568,810 | 2/1986 | Carmean | 219/10.55 B |
| 4,580,025 | 4/1986 | Carlson et al. | 219/10.55 B |
| 4,613,739 | 9/1986 | Richards | 219/10.55 B |

*Primary Examiner*—Philip H. Leung

*Attorney, Agent, or Firm*—Birch, Stewart, Kolasch & Birch

[57] ABSTRACT

A microwave oven including an oven main body having a heater, and a function unit removably attachable to a front portion of the main body is provided. The function unit includes an optical reader for reading cooking data, an input device for entering restriction data as to restriction requirements for cooking, a memory for storing the cooking data entered by the reader and the restriction data entered by the input device, a calculator-controller for comparing and matching the cooking data and restriction data retrieved from the memory and selecting at least one menu fulfilling the restriction requirements from the cooking data, a device for operating the heater according to the selected cooking data when the function unit is attached to the main body, and a display for presenting data when the restriction data is entered and output. By a simple procedure, the desired menu is selectable which satisfies various cooking restriction requirements contemplated by the chef. The function unit permits the chef to select menus and enter cooking data at a desired place away from the main oven body.

6 Claims, 19 Drawing Sheets

Display output

Flow chart
Display output
Procedure
S3
RETRIEVAL
S4
SUITABLE MENUS AVAILABLE
YES
NO
S5
WARNING MESSAGE
S61
RESTRICTION SEVERITY SWITCH ON
S62
DESIRED SEVERITY SELECTED
NO
YES
S63
RETRIEVAL
S64
SUITABLE MENU(S) AVAILABLE ?
NO
YES
A1
D5
Your Menu Not Found
Relax Your Reguirement
D6
Locate ▽ to your taste
▽
4/4 3/4 2/4 1/4
D7
▽
4/4 3/4 2/4 1/4
A2
D9
Restriction Severity
H
L
Push
A3

Flow chart

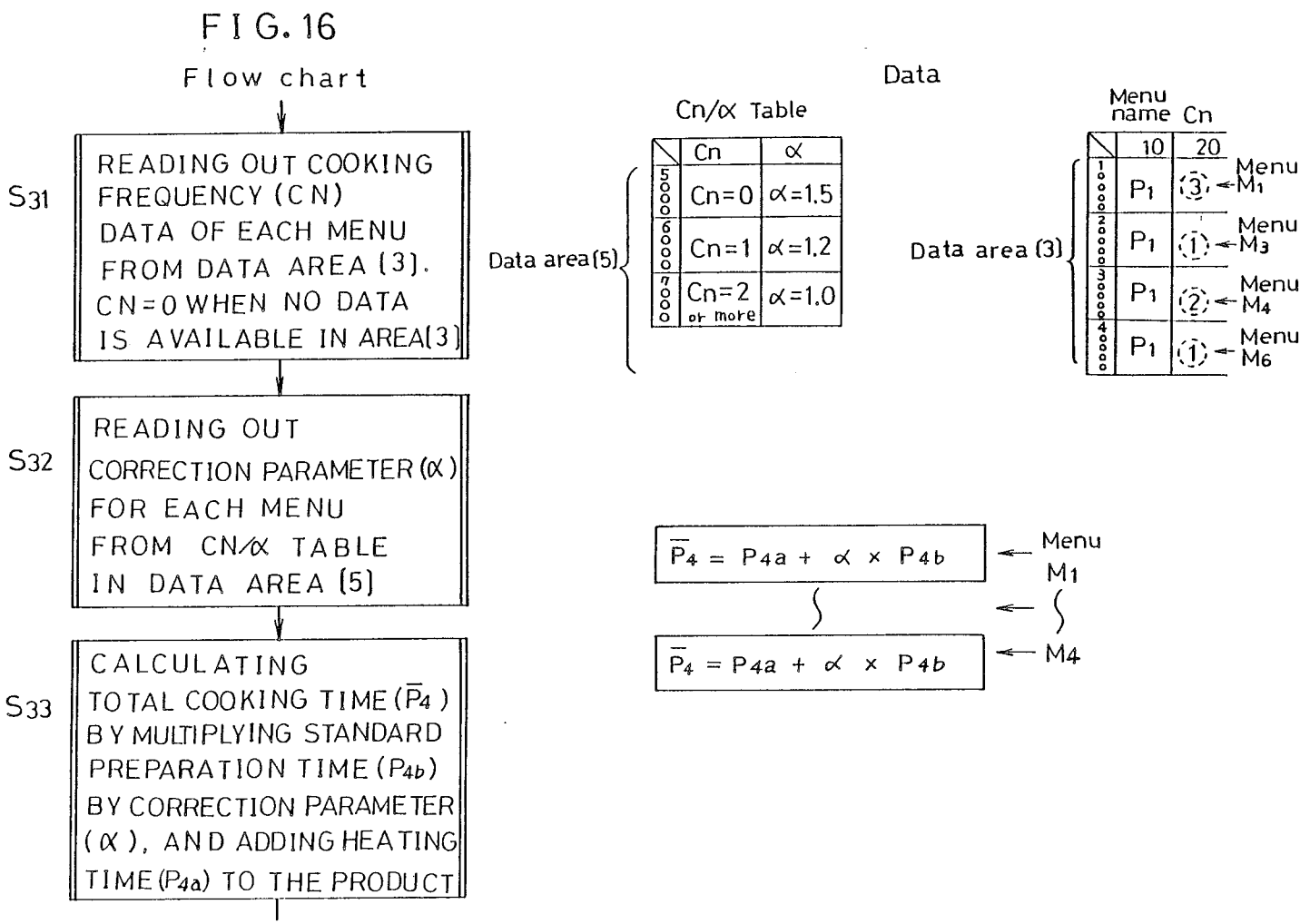
FIG. 16
Flow chart
S31
READING OUT COOKING FREQUENCY (CN) DATA OF EACH MENU FROM DATA AREA (3). CN=0 WHEN NO DATA IS AVAILABLE IN AREA(3)
S32
READING OUT CORRECTION PARAMETER (α) FOR EACH MENU FROM CN/α TABLE IN DATA AREA (5)
S33
CALCULATING TOTAL COOKING TIME ($\bar{P}_4$) BY MULTIPLYING STANDARD PREPARATION TIME ($P_{4b}$) BY CORRECTION PARAMETER (α), AND ADDING HEATING TIME ($P_{4a}$) TO THE PRODUCT
Data
Cn/α Table
Cn
α
Cn=0
α=1.5
Cn=1
α=1.2
Cn=2 or more
α=1.0
Data area (5)
Menu name
Cn
10
20
P1
Menu M1
Menu M3
Menu M4
Menu M6
Data area (3)
$\bar{P}_4 = P_{4a} + \alpha \times P_{4b}$
$\bar{P}_4 = P_{4a} + \alpha \times P_{4b}$
Menu M1
M4

A1
TIME SETTING SWITCHES (H, M) ON
S46
ENTRY SWITCH ON.
S47
CALCULATING WHEN TO START PREPARATION FOR THE MENU SPECIFIED BY ENTRY SWITCH
S48
DISPLAYING MENU NAME, PREPARATION START TIME
S49
SELECT SWITCH ON
S50
DESIRED MENU AVAILABLE ?
NO
YES
S51
ENTRY SWITCH ON
S52
A2
Desired Dinner Time is 19H 30M
D22
Golden Onion Quiche P40 to Start At 18H 30M
D23
A3
Dinner Time
(M)H
O23
40
ENTRY
O24
42
Select
O25
38
ENTRY
O26
42

MICROWAVE OVEN HAVING A PLURALITY OF STORED COOKING PROGRAMS

BACKGROUND OF THE INVENTION

1. Field of the Invention

The present invention relates to a microwave oven having microcomputer incorporated therein and operable according to cooking programs stored in the microcomputer.

2. Description of the Prior Art

Cooking programs are conventionally entered into such microwave ovens incorporating a microcomputer, for example, with use of a cookbook having printed therein photographs and descriptions of various menus and bar code symbols each representing a cooking program for each menu, by tracing the bar code of the desired cooking program with a bar code reader. U.S. Pat. No. 4,323,773 discloses a method of entering cooking programs by bar code reading.

With reference to a large number of photographs contained in the cookbook, a menu which stimulates one's appetite can be selected much more quickly from an extremely wider variety of menus when the bar code symbol printed in the cookbook is thus utilized than when one's imagination is resorted to for selecting a particular menu with reference to the names of menus only. Moreover, the cooking program selected can be entered into the oven very easily without necessitating special skill.

Nevertheless, the conventional method of entering cooking programs into the microwave oven is mainly based on one's appetite excited by viewing photographs, i.e. on sensory selection, so that it is exceedingly troublesome to select a suitable menu with consideration given to the following conditions or requirements attendant on the menu. The chef relies solely on mental work when checking whether the contemplated menu can be cooked within a limited period of time available, whether menus of the same type only are selected frequently or whether the desired caloric value is achievable. For example, when a menu is to be selected from among about ten preselected suitable menus with consideration given to the above conditions, a considerably large number of items of data must be considered, so that there arises the problem that it becomes almost impossible to select an appropriate menu by mental work. Furthermore, when selecting a particular menu, the chef is influenced by her own likes and dislikes likes either consciously or unconsciously. This is likely to make reasonable selection difficult.

SUMMARY OF THE INVENTION

The present invention provides a microwave oven including an oven main body having heating means, and a function unit removably attachable to a front portion of the main body, the function unit having optical reading means for reading cooking data, input means for entering restriction data as to restriction requirements for cooking including heating conditions and cooking time, a memory for storing the cooking data entered by the optical reading means and the restriction data entered by the input means, calculation-control means for comparing and matching the cooking data and restriction data retrieved from the memory and selecting at least one menu fulfilling the restriction requirements from the cooking data, output means for outputting the selected cooking data, and display means for presenting data when the restriction data is entered and output, so that the heating means is controlled according to the selected cooking data when the function unit is attached to the main body.

According to the present invention, the chef first visually preselects, for example, 5 to 10 menus from a cookbook having printed therein photographs and descriptions of various menus and cooking data relating thereto, before selecting the desired menu. Next, the the cooking data as to the 5 to 10 menus preselected from the cookbook is read by the optical reading means included in the function unit, whereupon the data is stored in the memory. The cooker then manipulates the input means while conversing with the display means on the function unit to enter restriction data representing the restriction requirements for cooking, whereby the data is stored in the memory.

The cooking data and the restriction data stored in the memory are retrieved by the calculation-control means and compared for matching, whereby the menus meeting the restriction requirements are selected from the cooking data relating to the 5 to 10 menus and stored in the memory. The selected menus are presented on the display means. The menu to be actually cooked is finally selected from among the selected menus meeting the restriction requirements. The result is stored in the memory. Consequently, even when there are many menus suitable for cooking, the desired-menu fulfilling the conditions contemplated by the chef can be determined quickly and reasonably by a very simple procedure without resorting to the cooking experience or memory of the chef.

Preferably, the input means is so adapted as to set a priority order for the restriction data at the will of the chef. Further preferably, the input means is so adapted as to invalidate the restriction data from item to item in an order reverse to the priority order and to specify the number of data items to be invalidated.

Preferably, the calculation-control means is adapted to cause the display means to show the progress of heating during cooking, when the function unit is attached to the main body.

BRIEF DESCRIPTION OF THE DRAWINGS

FIG. 16 is a flow chart showing the steps of calculating when to start preparation for cooking, and diagrams illustrating stored data.

DESCRIPTION OF THE PREFERRED EMBODIMENTS

The present invention will be described below in detail with reference to the illustrated embodiment.

Figure 1:
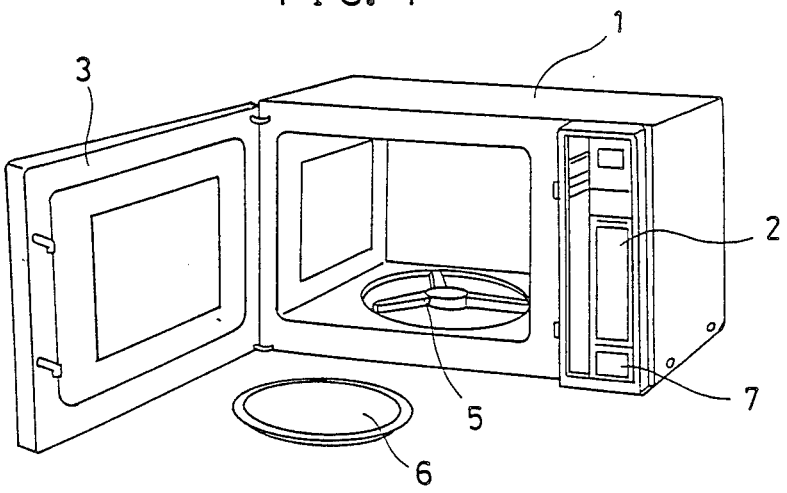
FIG. 1 is a perspective view showing the appearance of a microwave oven embodying the invention.

FIG. 1 shows the appearance of a microwave oven embodying the invention and generally comprising an outer case cabinet 1, a control unit 2, a door 3, a tray support 5, a tray 6 and a door opening switch 7. The tray support 5 is adapted to hold the tray 6 thereon and to transmit the rotation of a motor provided on the rear side of the cabinet 1 to the tray 6 to rotate the tray 6, whereby a cooking material placed thereon is uniformly exposed to microwaves.

Figure 2:
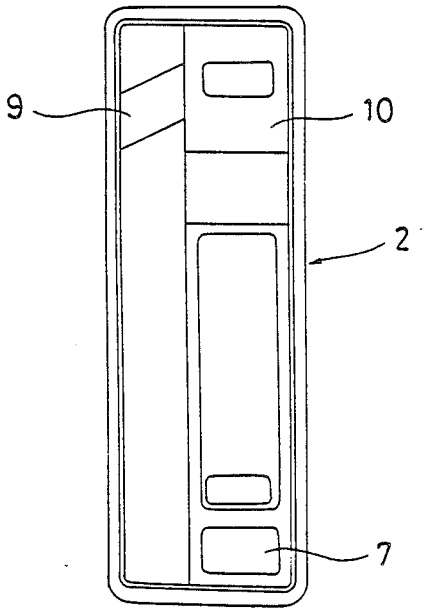
FIG. 2 is a front view of a control unit shown in FIG. 1.

FIG. 2 is an enlarged front view of the control unit 2. The drawing shows a cooking start switch 9 and a cover panel 10 for a function unit 13.

Figure 3:
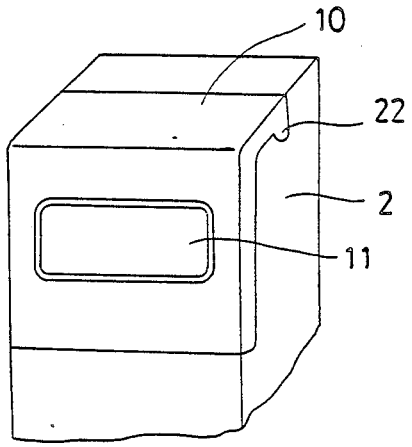
FIG. 3 is a perspective view of a function unit cover panel shown in FIG. 2.
Figure 4:
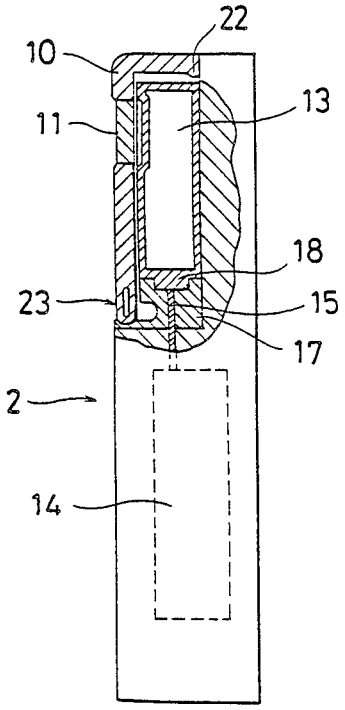
FIG. 4 is a side elevation partly in vertical section and showing the control unit of FIG. 2.

FIG. 3 is an enlarged perspective view showing the upper portion of the control unit 2. FIG. 4 is a view partly in section and showing the control unit 2. With reference to FIG. 3, the cover panel 10 for the function unit 13 provides a shell for the front upper portion of the control unit 2 and also serves to protect the function unit 13 when the function unit is installed in the control unit 2 as seen in FIG. 4. The panel 10 has a window 11 which is made of a transparent material so that the data fed to a display 30 of the function unit 13 can be read when the function unit 13 is installed in the control unit 2.

Figure 5:
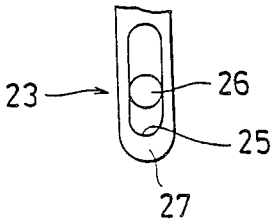
FIG. 5 is a fragmentary view of the cover panel of FIG. 4 to show a support portion thereof.
Figure 6:
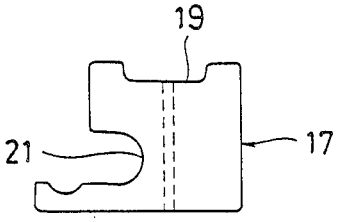
FIG. 6 is a side elevation of an engaging member shown in FIG. 4.

With reference to FIG. 4, the function unit 13 is for selecting menus and calculating when to start preparation for cooking as will be described later as the main features of the invention. The oven has a control assembly 14 for controlling the oven in accordance with the heating program to be given by the function unit 13 through a signal transmission channel 15. An engaging member 17 is provided within the control unit 2. As seen in FIG. 6, the engaging member 17 is formed at its top with an engaging portion 19 engageable with an engaging portion 18 of the function unit 13 and has in its front side an engaging portion 21 engageable with the cover panel 10. The signal transmission channel 15 is provided in the engaging member 17 and in the control unit 2 for guiding therethrough signals from the function unit 13 to the control assembly 14. The cover panel 10 is fixed to the control unit 2 by the engagement of a projection 22 at the rear end of the panel upper portion in a recessed portion in the control unit 2. On the other hand, the cover panel 10 is formed at its lower end with a support portion 23 having a slot 25, in which a pin 26 is inserted as seen in FIG. 5, whereby the cover panel 10 is rotatably retained on the unit 2. When the cover panel 10 is rotated through 90 degrees to a horizontal position, the lower extremity of the panel support portion 23 is inserted in the engaging portion 21 of the member 17, whereby the cover panel 10 is fixedly positioned horizontally.

Figure 7:
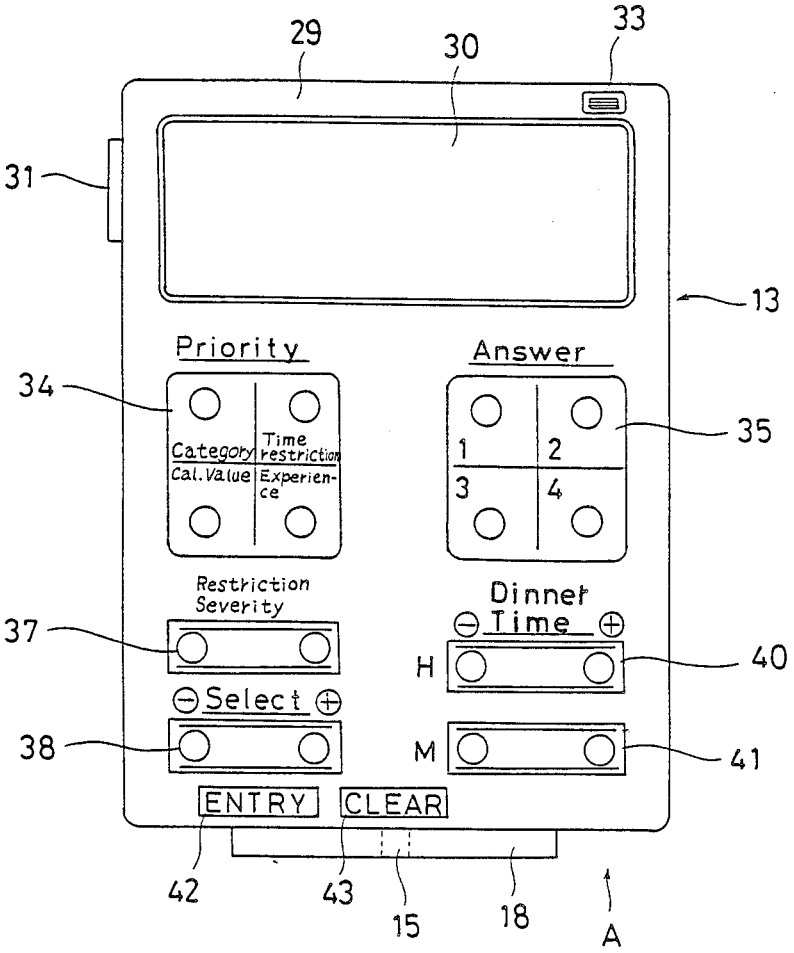
FIG. 7 is a front view showing the function unit of FIG. 4.

FIG. 7 is a front view of the function unit 13, which generally comprises a main body 29, a display 30 serving as display means, a bar code reader 31 serving as optical reading means, an electronic buzzer 33, a priority order setting switch 34 serving as input means, an answer switch 35 serving as the same, a restriction severity switch 37, a select switch 38, time setting switch H 40 and switch M 41, ENTRY switch 42, CLEAR switch 43, the engaging portion 18 engageable with the engaging member 17 and the signal transmission channel 15.

The display 30 is, for example, a dot matrix liquid crystal display or the like. The priority order setting switch 34 is a seesaw switch of the square type. Depression of a desired portion of the switch 34 selectively enters one of four restriction requirements (category, time restriction, caloric value and experience). The switch 34 also serves to specify the priority order of the restriction requirements which is to be considered in selecting menus. A priority order is set in the order in which the restriction requirements are selected by depressing the switch 34. Like the switch 34, the answer switch 35 is a seesaw switch of the square type. The switch 35 selectively enters an answer specifying one of the selection numbers for a restriction requirement shown on the display 30 when the requirement is entered. The restriction severity switch 37 is a step switch of the seesaw type. Many different items of data can be entered by pushing the switch 37 at a selected portion a selected number of times. As to the four kinds of restriction requirements entered by the priority order setting switch 34, the severity switch 37 determines the number of requirements, as counted from the one selected first in a descending order of priority, to be fulfilled.

The select switch 38 is a seesaw type step switch. When a plurality of menus meeting the selected restriction requirements are selected from among the items of cooking data entered by the bar code reader 31, the select switch 38 gives an instruction to present the names of the selected menus one by one on the display 30 as will be described later. The time setting switches H 40 and M 41 are each a seesaw type switch and are used for entering the dinner start time desired by the user. The switch H 40 is an "hour" setting switch which is adapted to set the hour in one-hour units every time it is depressed once. The switch M 41 is a "minute" setting switch for setting time in 10-minute unit every time it is depressed once. To alter the time setting easily, each of the switches 40 and 41 is so adapted that when one of the illustrated portions, i.e. "+" side or "−" side, thereof is depressed, the setting can be altered by addition or subtraction.

ENTRY switch 42, when manipulated, gives one of the following execution instructions (1) to (3) in the step concerned of the operation of the function unit 13 to be described.

(1) Instruction to specify the menu to be finally selected from among the menus suitable for cooking and presented on the display 30.

(2) Instruction to calculate when to start preparation for cooking the desired menu.

(3) Instruction to transfer to the control assembly 14 of the microwave oven the heating program included in the cooking data which is read by the bar code reader 31 and which relates to the finally selected menu (after the function unit 13 has been installed in the control unit 2). Subsequently, the switch automatically serves to newly register the number of times (frequency) the heating program for the finally selected menu is used, in a specified area in the memory to be described later or to renew such data.

CLEAR switch 43, when manipulated, gives one of the following execution instructions (1) and (2).

(1) Instruction to erase the cooking data relating to menus and entered upon reading by the bar code reader 31.

(2) Instruction to ease the restriction requirement priority order and answers entered by the setting switch 34 and the answer switch 35, respectively.

The instruction (1) is executed by depressing CLEAR switch 43 once, and the instruction (2) by pushing the switch 43 twice in succession.

The function unit 13 is connected to the control assembly 14 by the signal transmission channel 15 when the engaging portion 18 of the function unit 13 is engaged with the engaging portion 19 of the engaging member 17 in the control unit 2. A signal transmitted from the function unit 13 and representing the heating program for the oven is fed to the control assembly 14 in the control unit 2 through the signal transmission channel 15.

When removed from the control unit 2 after opening the cover panel 10, the function unit 13 serves as an independent unit, while when attached to the control unit 2, the function unit 13 serves as input-output means for the control assembly 14. Preferably, therefore, the function unit 13 is provided in a front portion of the microwave oven main body.

Figure 8:
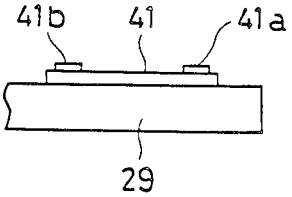
FIG. 8 is a fragmentary view of the same as it is seen in the direction of an arrow A in FIG. 7.

FIG. 8 is a fragmentary view of the function unit 13 as it is seen in the direction of arrow A in FIG. 7. The time setting switch M 41, a seesaw switch, is embedded in the main body 29 of the unit 13. An actuating projection 41*a* or 41*b* on the switch 41, when depressed, selects the mode to be specified by the switch 41.

Figure 9:
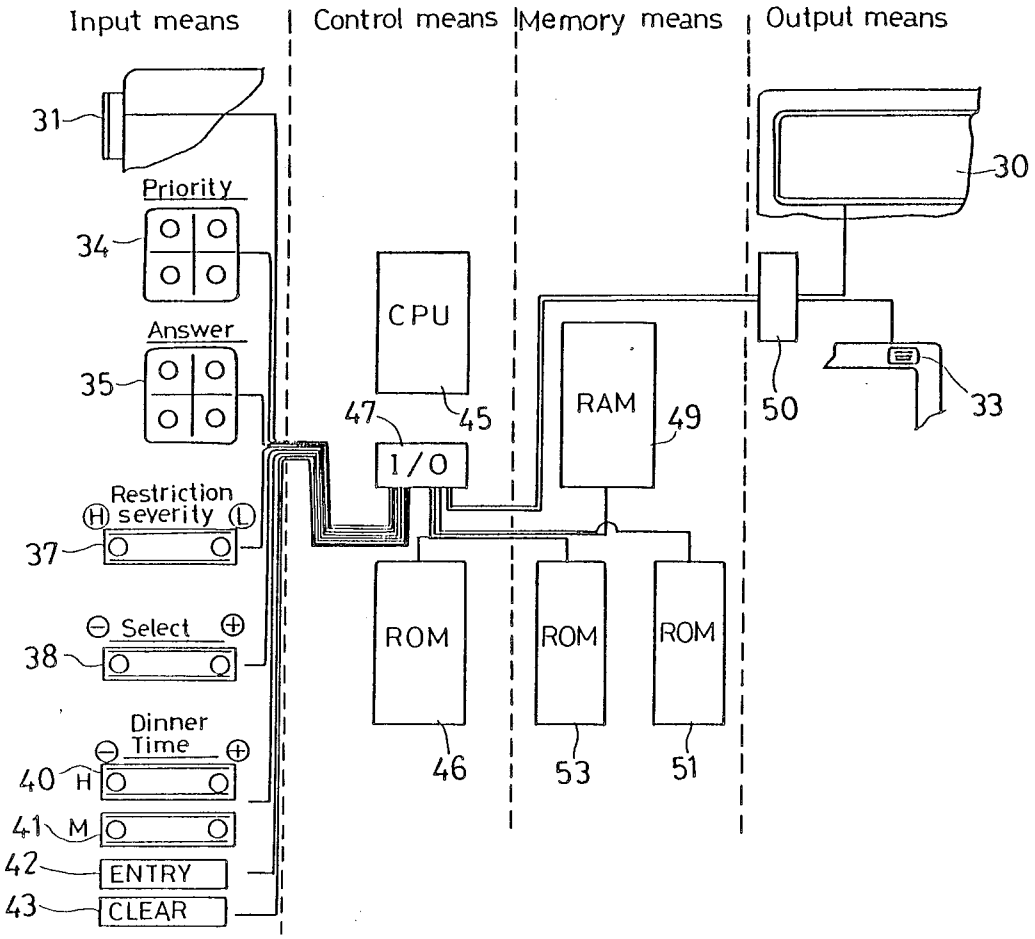
FIG. 9 is a block diagram of the function unit.

FIG. 9 is a block diagram showing the function unit 13 as divided into the input means, control means, memory means and output means, which are shown as arranged from left to right.

The input means serves to enter the conditions desired by the user and comprises the following means (a) to (f).

(a) Input means (bar code reader 31) for the cooking data as to the menus to be selected.

(b) Input means for restriction requirements (priority order setting switch 34, answer switch 35, restriction severity switch 37).

(c) Means for changing the data to be given to the display 30 (select switch 38).

(d) Means for entering dinner start time for calculating when to start preparation for cooking (time setting switches H 40 and M 41).

(e) Means for entering an instruction to load a heating program for the finally selected menu onto the control assembly 14 (ENTRY switch 42).

(f) Means for clearing input data (CLEAR switch 43).

The control means, which controls the operation of the function unit 13, includes a microcomputer having a ROM (read-only memory) 46, a CPU 45 serving as calculation-control means for controlling the function unit 13 according to a system program already stored in the ROM 46, and an input-output interface 47 connected to the CPU 45, the ROM 46, the above-mentioned input means and the memory means to be described below and also connected to the output means to be described below via a driver 50.

The memory means stores the data needed for the operation of the function unit 13 and includes the following memories: a RAM (random access memory) 49 having data areas [1] and [2] for storing therein cooking data as to menus from which suitable menus are selected and a data area [4] for storing the restriction data therein, a RAM 51 having a data area [3] for storing therein the number of times the heating program for each menu was used in the past, and a ROM 53 for use in storing the data needed when the function unit 13 serves as a monitor display for showing the heating state of the oven.

The output means includes the display 30 and the electronic buzzer 33. The display 30 gives instructions on input procedures and presents input results and output results. The buzzer 33 gives notice to the arrival of the time to start preparation for cooking.

To sum up, the function unit 13 with the foregoing construction has the following functions.

I. As a separate function unit:

(1) The function of entering menu cooking data by the bar code reader 31.

(2) The function of entering the desired priority order of restriction requirements for cooking and answers as to the restriction requirements.

(3) The function of retrieving menus meeting the specified restriction requirements.

(4) The function of calculating when to start preparation for cooking with cooking experience considered.

II. As input-output means for the control assembly 14 (when attached to the control unit 2):

(1) The function of loading heating programs onto the control assembly 14.

(2) The function of presenting progress of heating by the oven on the display 30.

The operation of the microwave oven having the construction described above will be described with reference to the flow charts of FIG. 10(*a*) and FIG. 10(*b*).

In step S1, the function unit 13 is removed from the control unit 2, and the cooking data for to 5 to 10 menus selected with reference to photographs in the cookbook is read by the bar code reader 31 and stored in the RAM 49 (pre-selection).

Step S2 enters the priority order of restriction requirements desired by the chef and answers to inquiries as to the restriction requirements.

In step S3, the CPU 45 retrieves the menus meeting the restriction requirements from the cooking data for the 5 to 10 menus entered (final selection).

In step S4, the CPU 45 inquires whether the restriction requirement meeting menus are present. When the answer is affirmative, step S7 follows, or if otherwise, step S5 follows.

In step S5, the CPU 45 presents a message requesting relaxed restriction requirements on the display 30 since no menu is available to satisfy the requirements.

In conformity with the request made in step S5, the chef reduces the severity of requirements in step S6, followed by step S3.

In step S7, the names of the plurality of menus fulfilling the restriction requirements are presented on the display 30 in succession along with the page numbers of the cookbook concerned.

In step S8, the menu desired by the chef, if found, is specified by ENTRY key 42, followed by step S10. If otherwise, the sequence proceeds to step S9.

When the cooker desires to change the priority order in step S9, step S2 follows again. If retrieval is to be resumed in the priority order already specified, the sequence returns to step S1.

In step S10, the chef enters a scheduled dinner start time.

In step S11, the CPU 45 calculates when to start preparation for cooking the menu finally determined in step S8, based on the scheduled dinner time entered in step S10. The result is shown on the display 30.

In step S12, the chef checks whether the menu can be cooked. If the result is affirmative, step S13 follows, or otherwise, the sequence returns to step S1 to reselect menus.

In step S13, the function unit 13 is installed in the control unit 2 on the oven, and the heating program included in the cooking data stored in the RAM 49 in step S1 is loaded into the control assembly 14, whereby the present process is completed.

Next, the above operation will be described in greater detail as the following procedures (1) to (4). (1) Entering cooking data by bar code reader 31 (FIG. 10(*a*) step S1)

Figure 11:
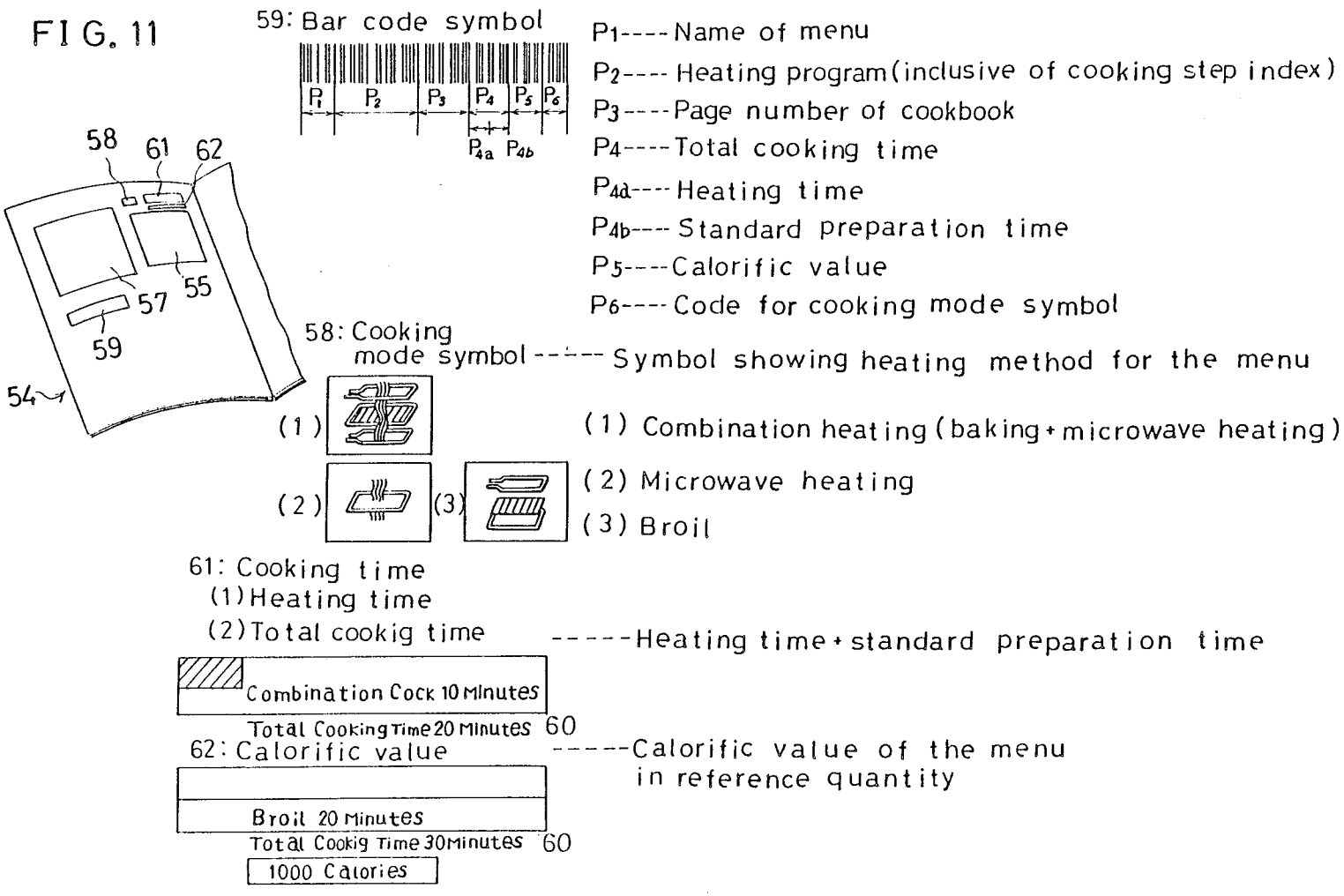
FIG. 11 is diagram showing a layout of a cookbook and illustrating the same.

FIG. 11 is a diagram showing a layout of the cookbook 54 prepared for the above microwave oven as an embodiment of the invention. The cookbook 54 has printed therein a photograph 55, description of cooking method 57, cooking time 61 and caloric value 62 as visible data, as commonly contained in conventional cookbooks. In addition to the above visible data, the cooking data for use in selecting the menu shown is printed in the form of a bar code symbol 59. The cooking data includes a code P6 for a cooking mode (heating method for the menu) symbol 58, total cooking time P4 (heating time P4*a*+standard preparation time P4*b*) and caloric value P5. The bar code symbol 59, which is provided to greatly facilitate the primary selection of the menu by the chef, includes the above cooking data (P4, p4*a*, P4*b*, P5, P6) for use in selecting the menu, and further the menu name P1, heating program P2 (inclusive of a signal relating to displaying) and page number P3 concerned in the cookbook 54 which are necessary for the CPU 45 to inform the chef of the selected menu. The code P6 representing the cooking mode symbol 58 is used for the CPU 54 to access a table of cooking mode symbols 58 prepared in the ROM 46 to present the corresponding symbol 58 on the display 30.

The bar code symbol 59 printed in the cookbook 54 is read by holding the function unit 13 as removed from the control unit 2 and tracing the symbol 59 with the bar code reader 31 on the unit 13 in contact therewith. Accordingly, the chef can enter the cooking data easily with reference to the visual data such as the photograph 55 without necessitating special training or the like. The cooking data as to each of the selected menus entered by the code reader 31 in this way is stored in the data area [1] of the RAM 49.

Figure 10A:
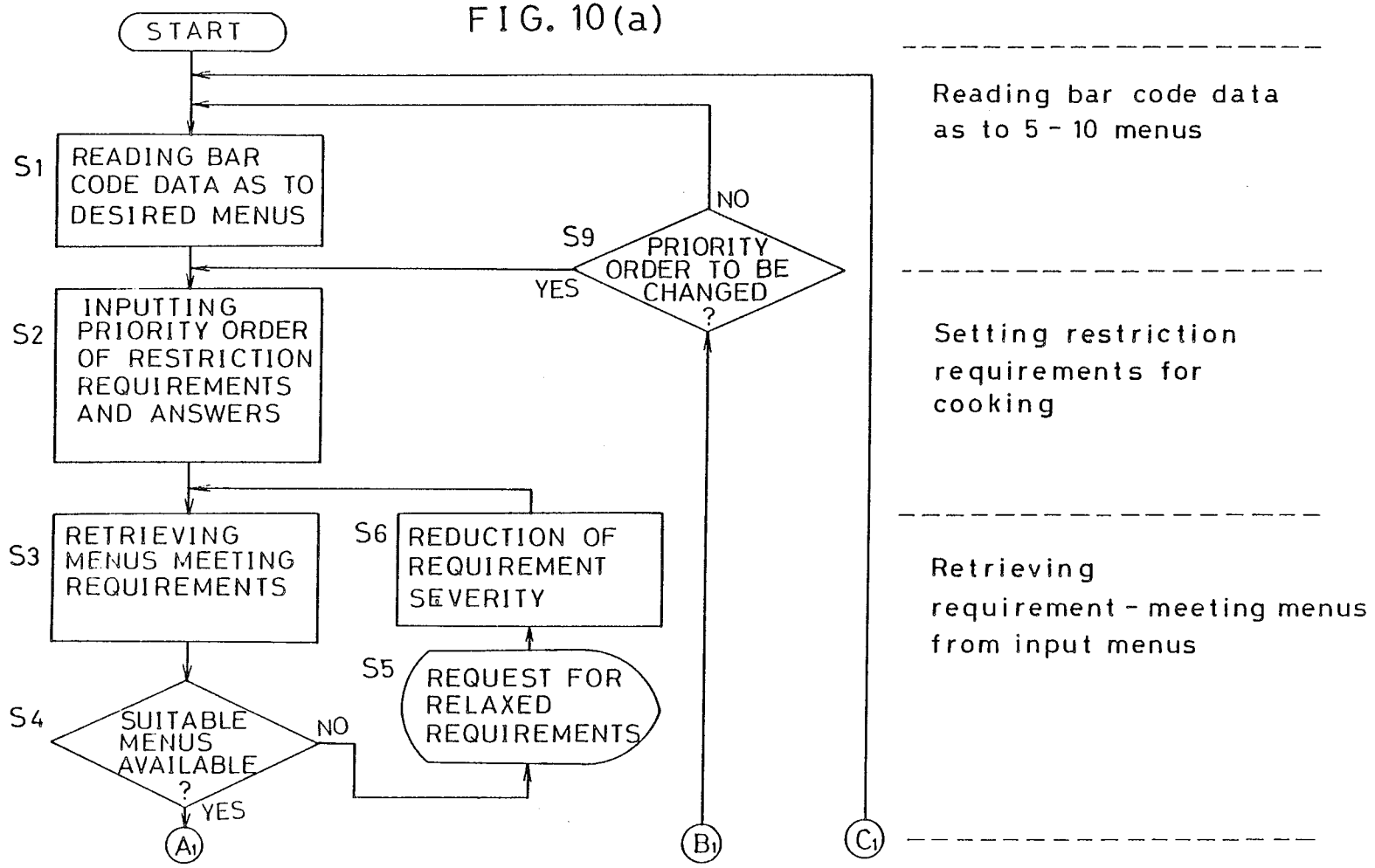
FIG. 10 (*a*) and FIG. 10 (*b*) are flow charts showing the menu selection routine to be executed by the function unit.
Figure 10:
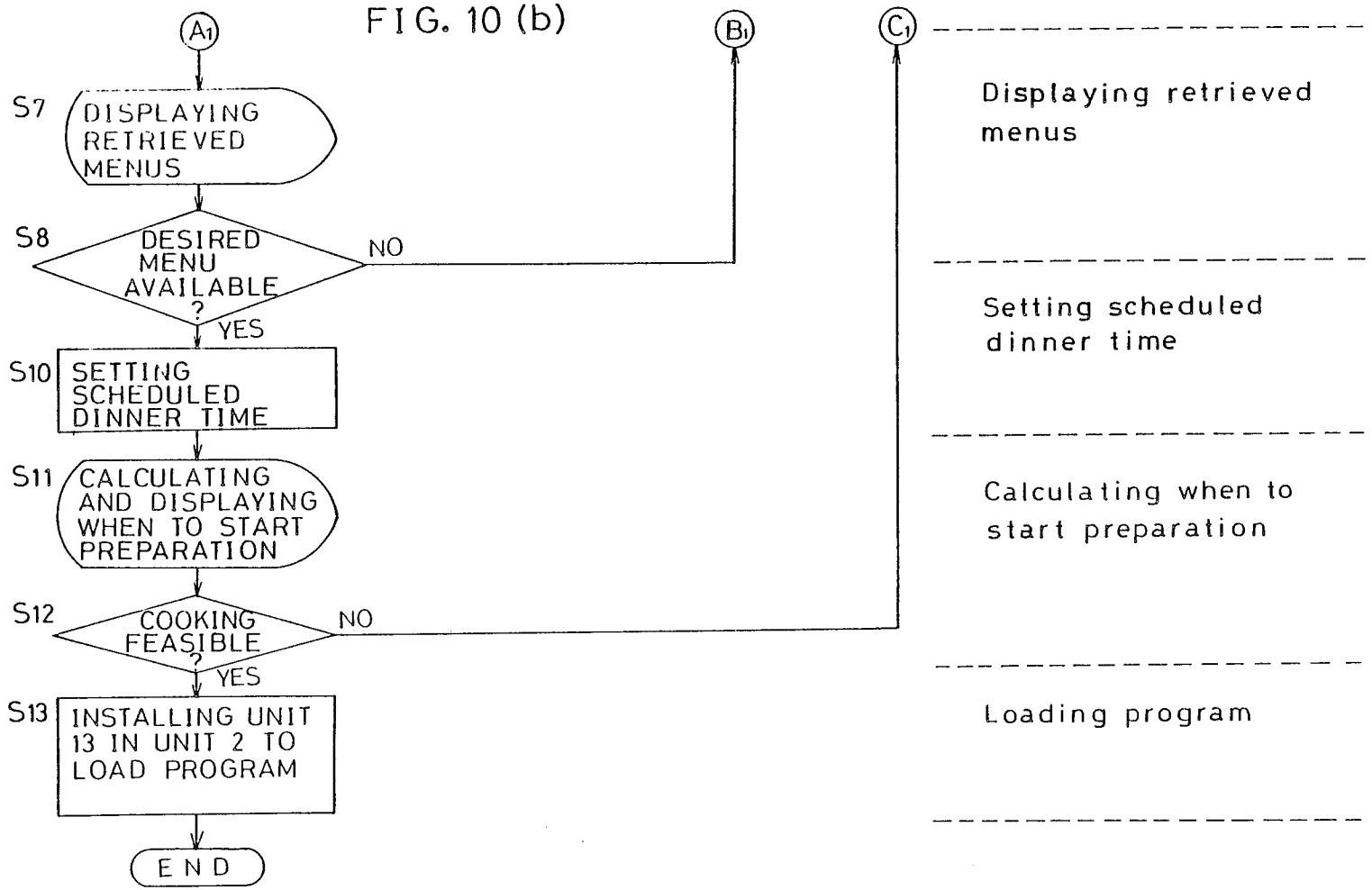

(2) Setting restriction requirements for cooking (FIG. 10(*a*) step S2)

The menus stored in the RAM 49 of the function unit 13 with reference to the photographs 55 showing the menus as finished, etc. in the cookbook 54 are selected based solely on the appetite of the chef. Accordingly, these menus have not been checked as to problems which are usually checked based on the memory of the chef resulting from her experience, e.g., whether the menu can be cooked on week days when a sufficient period of cooking time is not available to two-income families, whether the menu appears fresh to taste and what menu has a satisfactory caloric value in view of the health of the family. Further in examining these problems, it is important to note that the priority order of these items differ from chef to chef, and that even with the same chef, the priority order changes with a change in the living condition. In view of the above situation, the category of menu (heating method), time restriction, caloric value and experience are set as the items of restriction requirements to be checked, and the input means is given the function of setting these requirements in a priority order according to the present invention. Furthermore, the input means is adapted to re-set the minimum essential requirements to be fulfilled when no menu is available to satisfy all the restriction requirements specified so as to permit flexible selection.

Figure 12A:
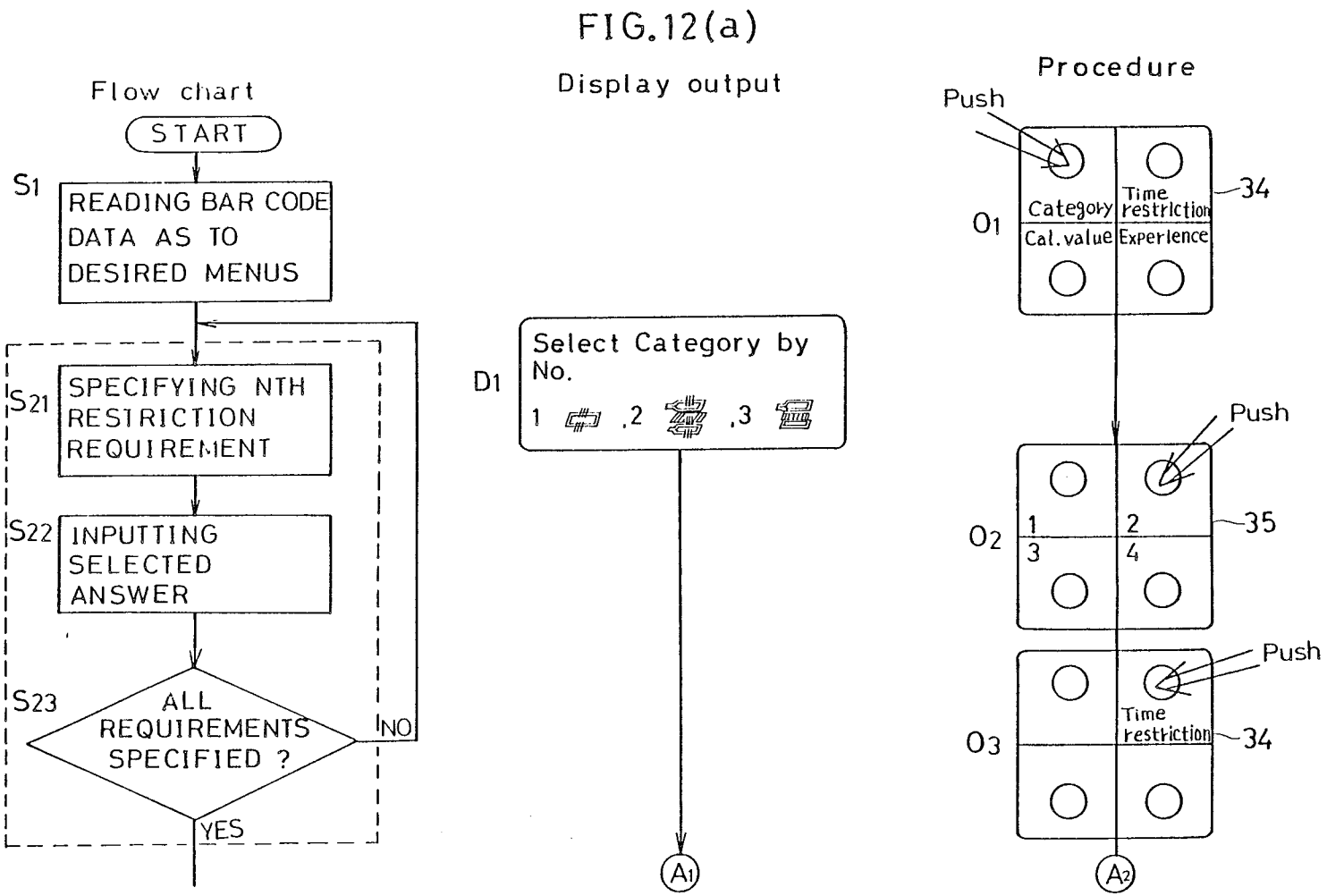
FIG. 12 (*a*), FIG. 12 (*b*) and FIG. 12(*c*) are flow charts showing a process for entering a priority order of restriction requirements and answers into the function unit, diagrams showing the procedure for executing the process, and diagrams showing examples of presentations on a display.
Figure 12B:
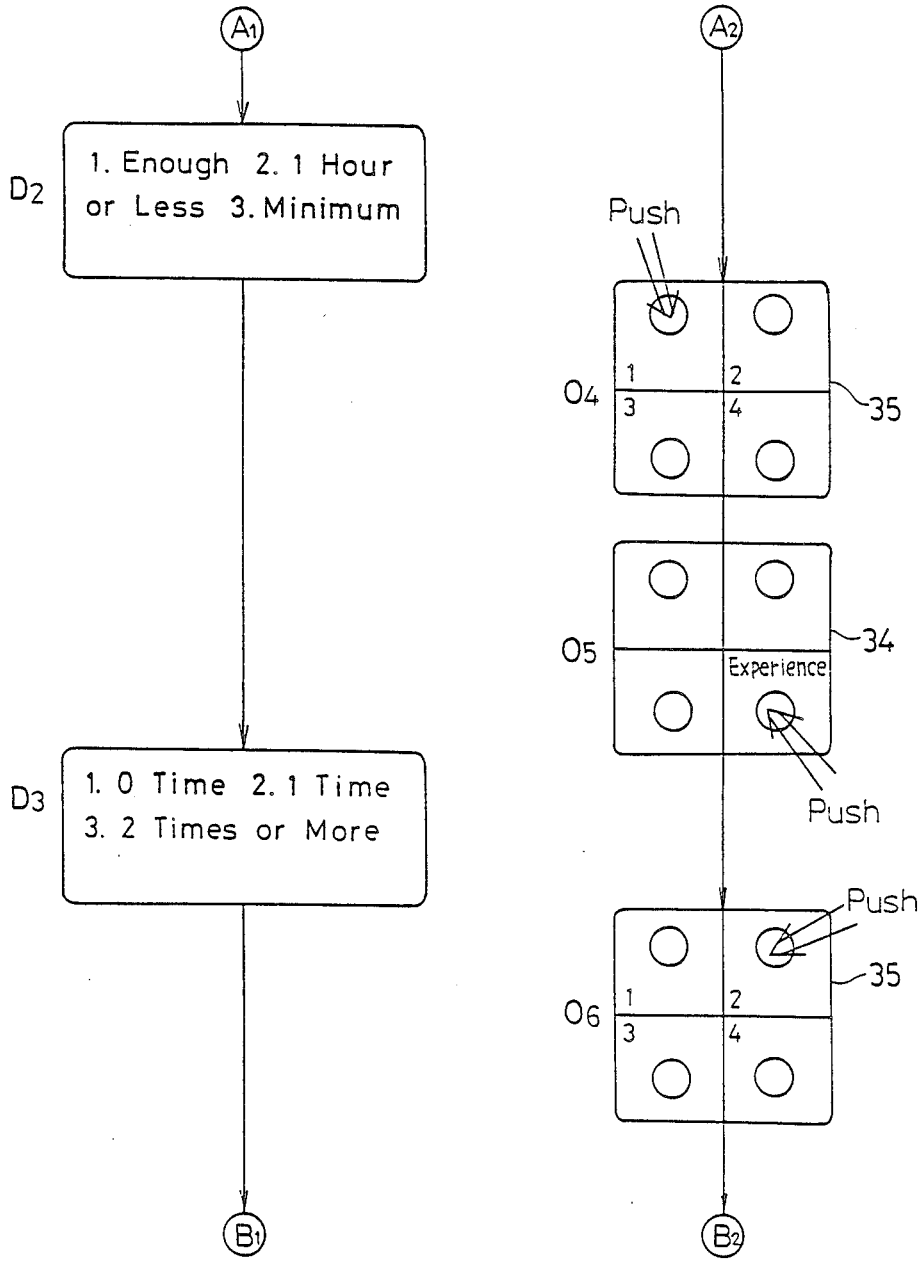
Figure 12C:
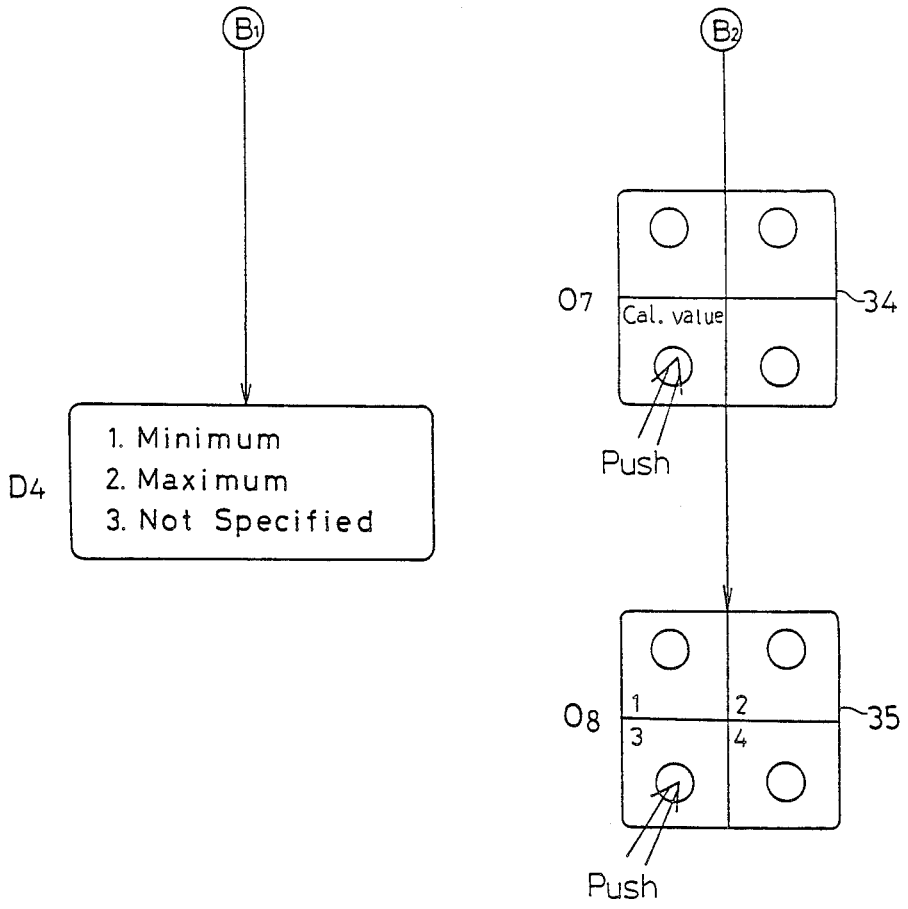

How to set restriction requirements for cooking in the desired priority order and how to enter answers as to these requirements will be described below with reference to the flow charts of FIG. 12 (*a*)–FIG. 12 (*c*). FIG. 12 (*a*)–FIG. 12 (*c*) also show a procedure for entering data into the function unit 13, presentations on the display 30 of the unit 13 during this procedure. In FIG. 10 and FIGS. 12 (*a*)–(*c*), like steps are referred to by like step numbers. When a series of steps in FIGS. 12 (*a*)–(*c*) show the details of a particular step in FIG. 10, the steps of the series are designated by attaching consecutive adscript numbers to the reference numeral of the corresponding step in FIG. 10, for example, by S21, S22, S23, . . . corresponding to S2.

In FIGS. 12 (*a*)–(*c*), the following priority order is given as an example to the above four kinds of restriction requirements.

(1) Category of menu
(2) Cooking time restriction
(3) Cooking experience
(4) Caloric value restriction The above priority order is set by entering in this order the four portions, i.e. category, time restriction, experience and cal. value sections, of the priority order setting switch 34 which is a square-type seesaw switch as already mentioned.

More specifically stated, the category section of the switch 34 is pushed in step S21 as shown in procedure step O1, whereupon the dispaly 30 presents the cooking mode symbols 58 representing different categories and numbers one of which is to be selected as an answer as shown in display step D1.

In step S22, the chef answers with one of the selection numbers shown in display step D1 by depressing, for example, the section "2" of the answer switch 35 which is a square-type seesaw switch, as seen in procedure step O2.

When step S23 finds that all restriction requirements have not been specified, the sequence returns to step S21.

In step S21, another restriction requirement and an answer are entered. More specifically, "time restriction" in the second place of the priority order is specified by pushing the corresponding section of the switch 34 in procedure step O3, whereupon selection numbers are presented as shown in display step D2.

In step S22, the selection number corresponding to the time available is specified by pushing, for example, the section "1" of the answer switch 35 again, whereby the second requirement is completely entered.

Steps S23 to S21 are thereafter repeated until all the restriction requirements are specified. In procedure steps O5 and O7, the priority order setting switch 34 is manipulated to set the remaining restriction requirements in the desired priority order. With reference to the selection numbers shown in display steps D3, D4, the answer switch 35 is manipulated in procedure steps O6, O8, respectively, to enter one of the numbers as an answer each time.

Upon step S23 detecting that all the restriction requirements have been specified, the sequence proceeds to step S3 in FIG. 10.

The above inputs (priority order of restriction requirements and answers as to the requirements) are stored in the data area [4] in the RAM 49.

(3) Retrieving and displaying menus meeting restriction requirements (FIG. 10, steps S3 to S8)

Figure 13A:
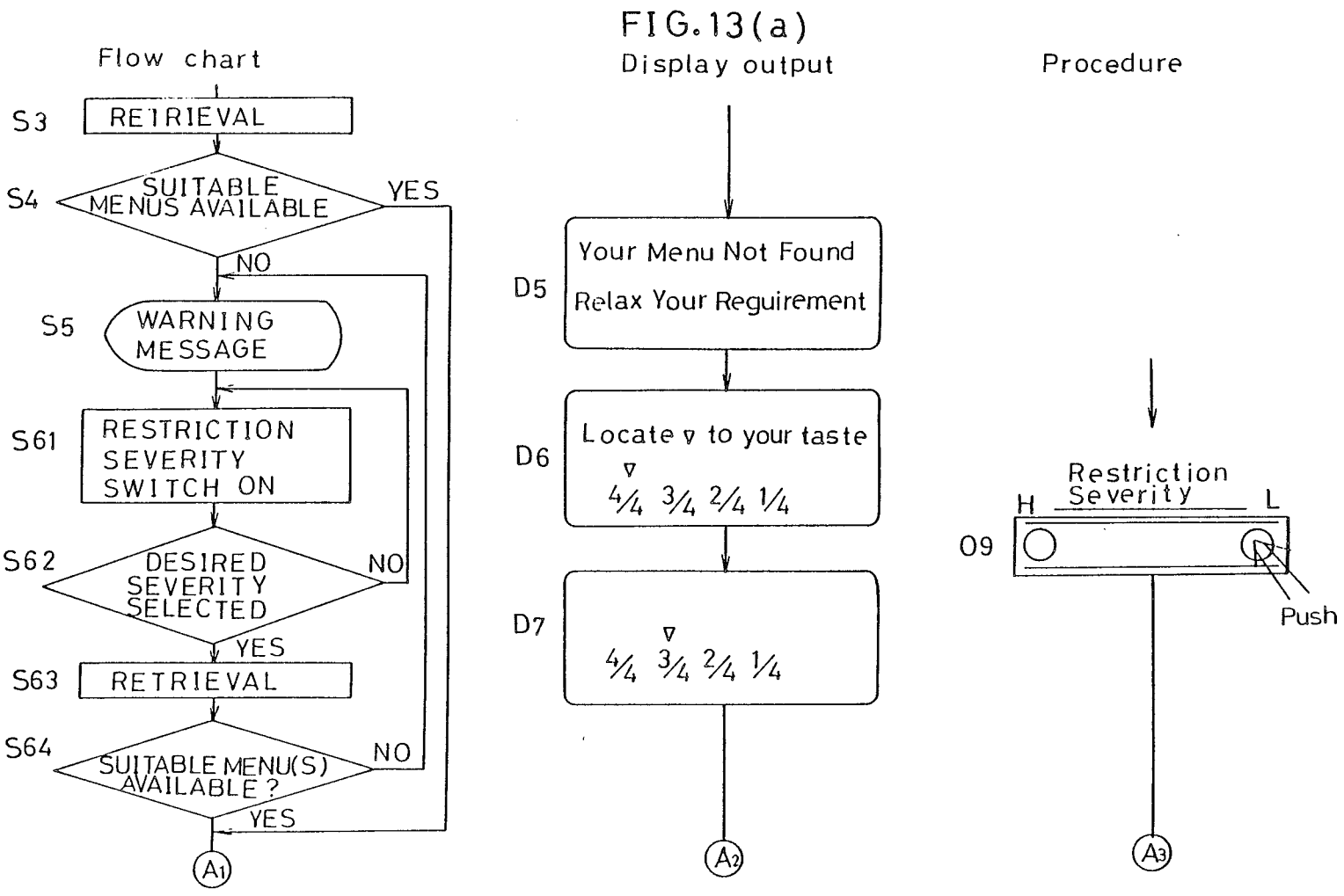
FIG. 13 (*a*) and FIG. 13 (*b*) are flow charts showing the steps of changing the priority order and showing the result of retrieval, diagrams showing the procedure therefor, and diagrams showing examples of presentations on the display.
Figure 13:
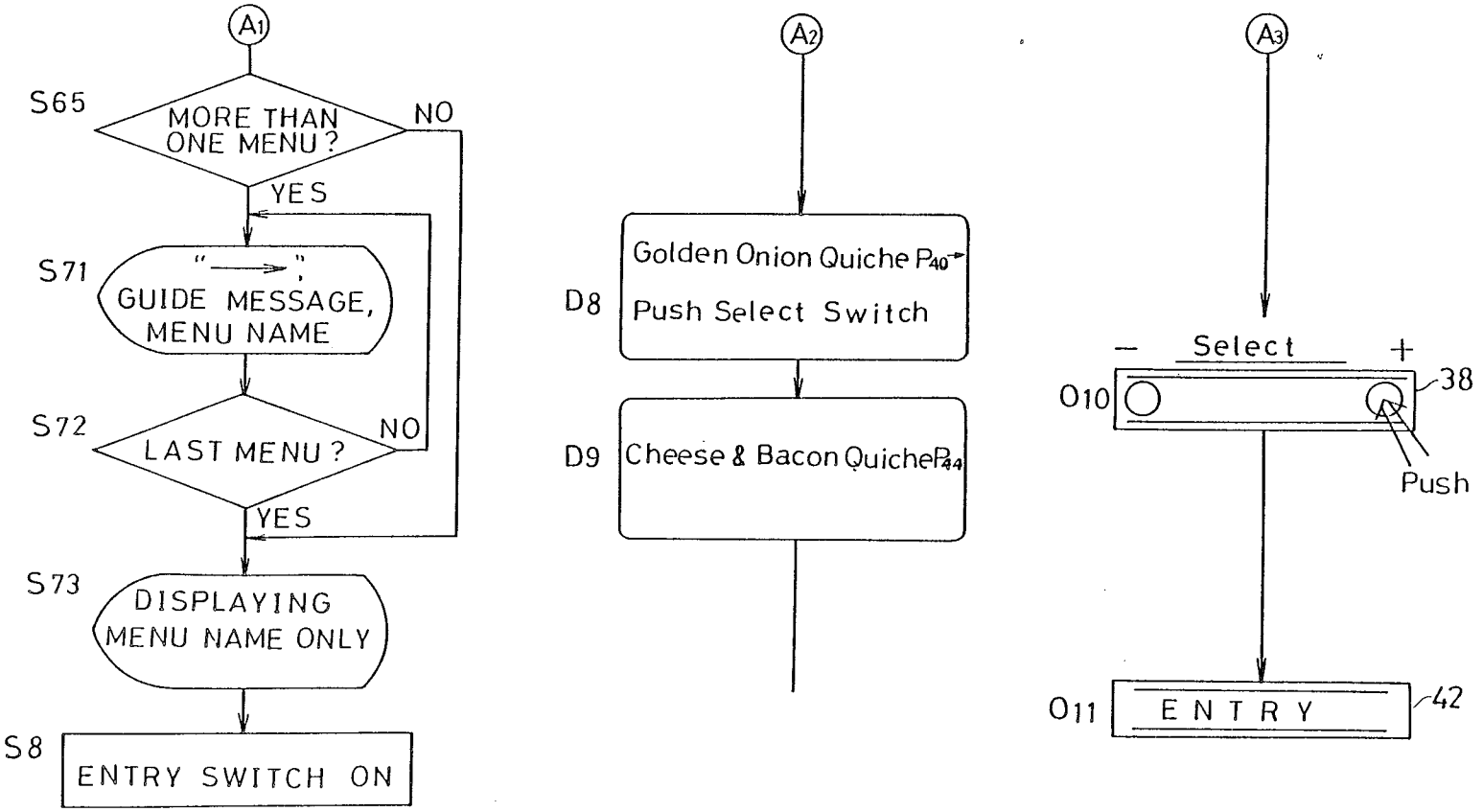

FIG. 13(*a*) and FIG. 13(*b*) show flow charts, examples of presentation on the display and a procedure.

In step S3, the CPU 45 compares the inputs of the restriction requirements with the cooking data as to the individual menus entered through the bar code reader 31 for matching to retrieve menus meeting the requirements, followed by step S4.

Step S4 inquires whether there are menus meeting the requirements. If the answer to the inquiry is in the affirmative, step S65 follows, or if otherwise, step S5 follows.

In step S5, the display 30 presents the message, "Your Menu Not Found. Relax Your Requirements" as shown in display step D5, whereupon the sequence proceeds to step S61.

In step S61, a message is given instructing the chef to reduce the requirement severity as shown in display step D6. More specifically, the display 30 presents the message, "Locate ▽ to Your Taste," meaning that a requirement severity indicating symbol "▽" is to be shifted, along with 4/4, 3/4, 2/4, ¼ each indicating a minimum number of essential requirements to be fulfilled relative to the total number of requirements. These numerical symbols are used for specifying the number of requirements to be adopted at the higher places in the priority order of the four requirements set in steps S21 to S23 in FIG. 12 to abandon the remaining requirement(s) at the lower place(s). In step S61, therefore, the restriction severity switch 37 is depressed as shown in procedure step O9. This switch 37 has two portions to be pushed. Depression of a projection on the "high (H)" side shifts the symbol "▽" leftward to increase the restriction severity, whereas depression of a projection on the "low (L)" side shifts the symbol rightward to lower the severity. Every push varies the restriction severity by an amount corresponding to one requirement. In the case of FIG. 13 (*a*), for example, the "L" projection (for decreasing the restriction severity) is depressed once to shift the symbol "▽" one step rightward as shown in display step D7. Consequently, the effective restriction requirements are the three of:

(1) Category of menu
(2) Cooking time restriction
(3) Cooking experience

The requirement "caloric value" is thus abandoned.

When required, the severity switch 37 is further depressed a required number of times in step S62 to reduce the number of restriction requirements.

In step S63, the CPU 45 retrieves menus again at the reduced restriction severity.

Step S64 checks whether suitable menus meeting the requirements are available. If the answer is negative, the sequence returns to step S5 to give a warning message again. When the answer is affirmative, the sequence proceeds to step S65. FIG. 13 (*b*) shows that a plurality of menus are selected which meet a reduced number of, i.e. three, restriction requirements.

The retrieval of the plurality of menus in step S65 is followed by step S71, whereas if a single menu is retrieved, step S73 follows.

In step S71, the display 30 shows the name of the first menu, the number of the cookbook page giving the menu, the symbol "→" and a guide message as shown in display step D8.

In response to the above message, the select switch 38 of the seesaw type is depressed on a projection at its "+" side as indicated in procedure step O10, whereby the plurality of menus meeting the restriction requirements are presented on the display 30 one after another in the increasing order of address numbers on the memory storing these menus. Every push of the switch 38 displays one menu.

Upon step S72 detecting that the menu to be displayed is the last of the plurality of retrieved menus, the sequence proceeds to step S73.

When step S73 displays the last menu, i.e. the menu stored with the largest address number in the memory, the display 30 presents only the name of the menu and the page number concerned of the cookbook 54 as shown in display step D9. Furtherwhen it is desired to recheck the menus already presented on the display 30, a projection on the "−" side of the select switch 38 is depressed. In this case, the menus are shown on the display 30 in the decreasing order of address numbers, one menu for every push of the switch.

When the desired one of the retrieved menus is presented on the display 30, ENTRY switch 42 is depressed in step S8, whereby the menu to be cooked is specified.

When the restriction requirements are to be changed because the desired menu is not obtained eventually, CLEAR switch 43 is depressed. This erases the cooking data entered by the bar code reader 31 and stored in the RAM 49 and also the restriction data entered by the priority order setting switch 34 and the answer switch 35 and stored in the RAM 49.

(4) Calculating when to start preparation for cooking (FIG. 10(*b*), steps S10 and S11)

Figure 14:
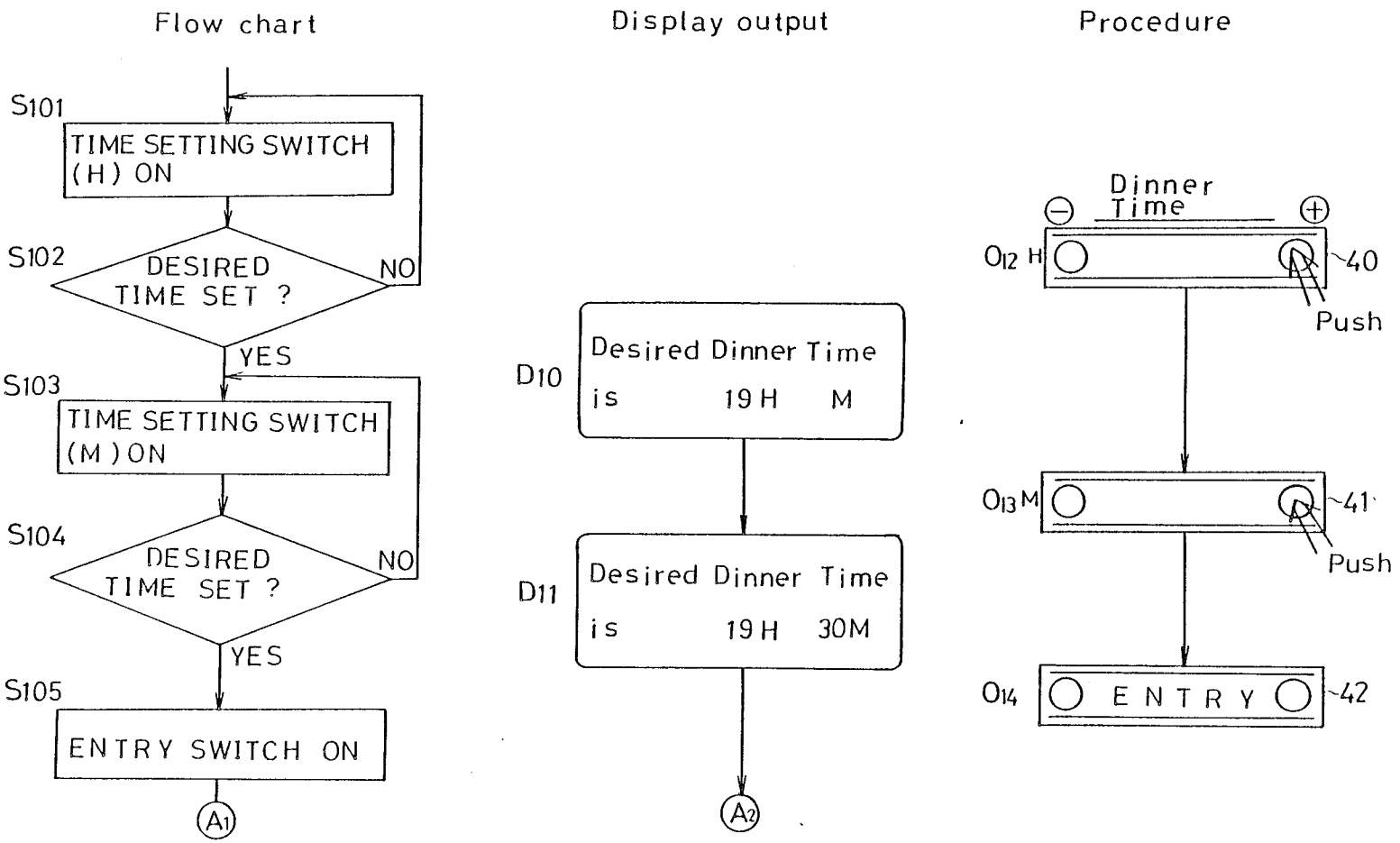
FIG. 14 (*a*) and FIG. 14 (*b*) are flow charts showing the steps of entering when to start a dinner and when to start preparation for cooking, diagrams showing the procedure therefor, and diagrams showing examples of presentations on the display.
Figure 14B:
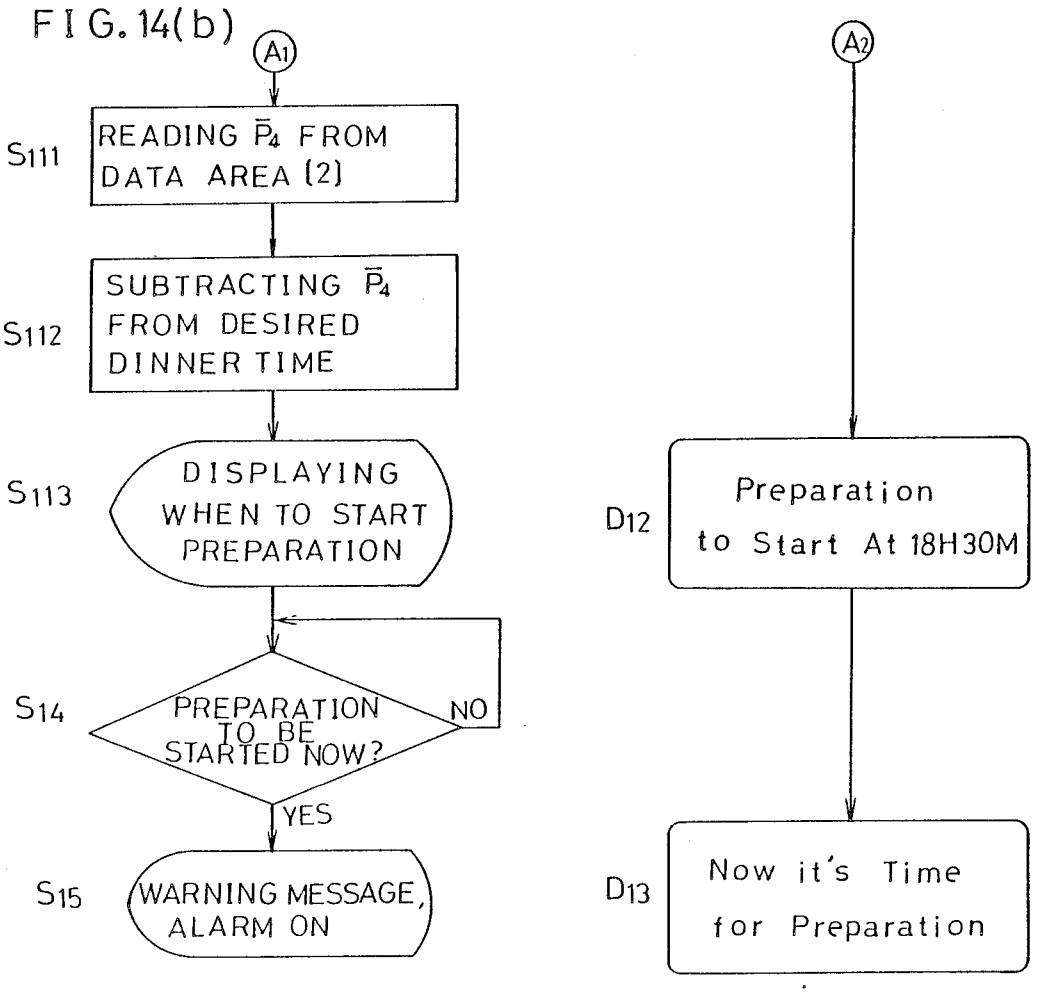

After the menu meeting the requirements set by the chef has been finally selected from among the plurality of menus preselected from the visual data in the cookbook 54 as described above, the time to start preparation for cooking is calculated so that the menu can be completely cooked in time for starting the dinner at the desired time. This process will be described with reference to the flow charts of FIGS. 14(*a*), 14(*b*). FIGS. 14(*a*), 14(*b*) also show the procedure for this process, exemplary presentations being shown on the display 30.

In steps S101 and S102, the chef depresses the time setting switch H 40, a seesaw switch, to set the "hour" of the desired dinner time as shown in procedure step P12, whereupon the time setting (hour only) is displayed as seen in display step D10.

The switch H 40 is an "hour" setting switch, while the time setting switch M 41 is a "minute" setting switch. One push of the "+" side projection of each of these switches 40, 41 advances the switch H 40 by one hour or the switch M 41 by 10 minutes. On the other hand, one push of the "−" side decreases the time setting by a decrement of the same time unit as above for correcting the advanced time setting.

In steps S103 and S104, the time setting switch M 41 is depressed to set the "minute" as shown in procedure step O13, whereupon the time setting is displayed as seen in display step D11.

After the scheduled dinner time has been set, ENTRY switch 42 is depressed in step S105, commanding the system to calculate when to start preparation for cooking the selected menu.

In step S111, the total cooking time $\overline{P4}$ (heating time P4*a*+preparation time $\alpha$·P4*b*) is read out from the data area [2] of the RAM 49, as corrected by the method to be described below in detail.

In step S112, the cooling preparation start time is calculated by subtracting the total cooking time $\overline{P4}$ from the dinner start time already set as above.

In step S113, the preparation start time is presented on the display 30 as shown in display step D12.

Subsequently, the function unit 13 is installed in the control unit 2 in engagement with the engaging member 17 and thereby connected to the control assembly 14. ENTRY switch 42 is then depressed, whereby the heating program for the menu to be cooked is transferred to the control assembly 14.

Upon the step S14 detecting that the calculated preparation start time has arrived, step S15 follows, presenting a warning message on the display 30 as shown in display step D13 and turning on the electronic buzzer 33 provided on the main body 29 of the function unit 13 to give an alarm. The system now waits for an instruction to start cooking.

The cooking data as to the preselected suitable menus entered into the function unit 13 by the bar code reader 31 is compared with the restriction requirement data entered by the priority order setting switch 34 and the answer switch 35 for matching by the method to be described below with reference to the flow charts of FIGS. 15(*a*), 15(*b*).

Figure 15:
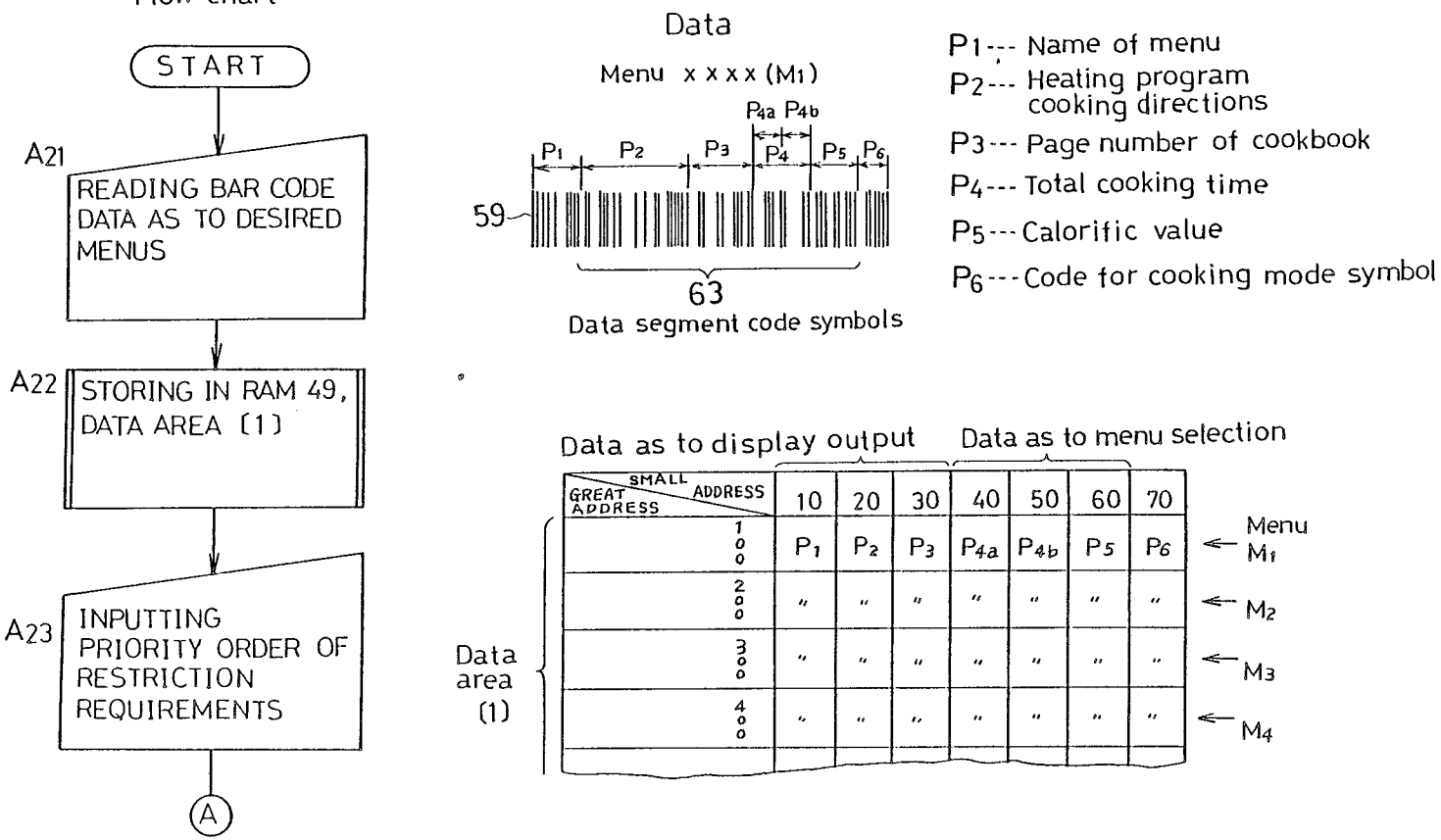
FIG. 15 (*a*) and FIG. 15 (*b*) are the menu retrieval process to be executed by the function unit and diagrams illustrating how to store items of data.
Figure 15:
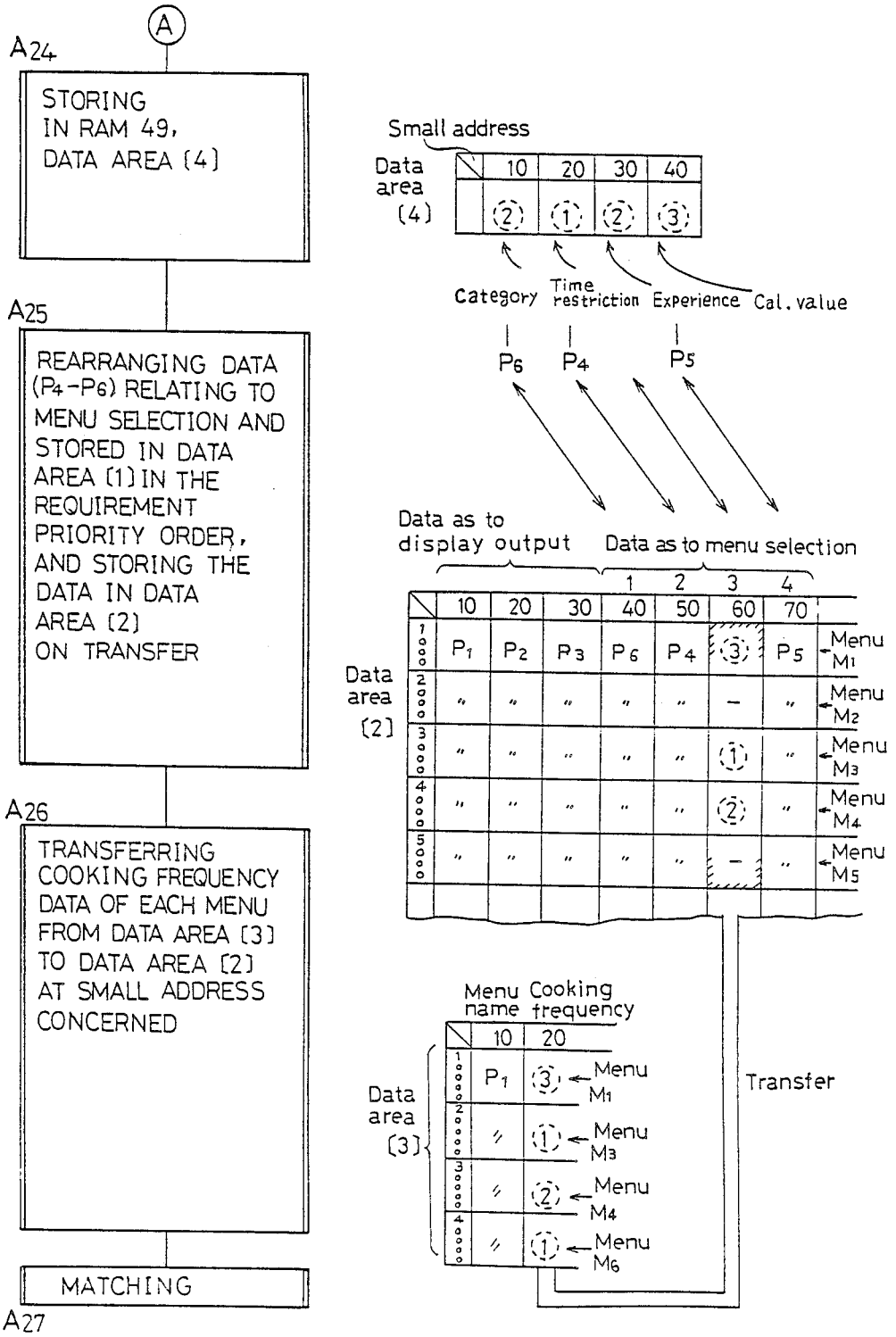

In step A21, the cooking data for the suitable menus is entered by the bar code reader 31 in terms of bar code symbols 59 (see FIG. 15 (*a*)).

The cooking data input is stored in the data area [1] of the RAM 49 in step A22. In the data area [1], a high address (100, 200, . . . ) is assigned to the data as to one menu. The individual items (the items P1 to P6 included in the symbol 59) constituting the data as to one menu are stored at respective small addresses (10, 20, . . . ) constituting the high address. This can be realized by the function of the CPU 45 to renew the high address to be used for storing every time it starts reading the symbol 59 for a new menu and by the function thereof to renew the small address for storing every time it reads a data segment code symbol 63 provided in the bar code symbol 59 for each data item therein.

In step A23, the desired priority order of the four restriction requirements is entered by manipulating the switch 34 as already described.

Step A24 specifies the order in which the items of data are to be registered at their respective specific addresses in the data area [4] of the RAM 49, in conformity with the priority order entered in step A23. Data area [4] shows that the specified order is the same priority order as in the procedure of FIGS. 12(*a*)–12(*c*). Next, each answer of the user is registered at the specified address upon the depression of the answer switch 35. On completion of the above requirement input procedure, the sequence proceeds to step A25.

Of the individual items (P1 to P6) of the menu cooking data stored in the data area [1] of the RAM 49, those relating to the selection of menu (total cooking time P4, caloric value P5 and cooking mode symbol P6) are rearranged in the requirement input order and stored in the data area [2] for each menu in step A25. Since the "experience" data at the third place of the priority order has not been stored in the data area [1] at this time, a small address 60 is secured in the data area [2] for storing this data therein later.

In step A26, data is retrieved as to,the frequency of cooking of each menu (experience). The cooking frequency of each menu is stored in the data area [3] of the RAM 51. As already stated, this data is automatically registered or renewed when the heating program concerned is loaded into the control assembly 14 by ENTRY switch 42, with the function unit 13 installed in the control unit 2. All menus (M1 to M5 in the case of FIG. 15(*b*)) registered in the data area [3] of the RAM 51 are checked as to their cooking record, and the cooking frequency data as to those already cooked in the past is registered at the specified location of the data area [2] of the RAM 49, i.e. at the small address 60 secured as above.

Of the menu cooking data entered by the bar code system, the items of data relating to menu selection are re-registered by the above process in the same order as the priority order of restriction requirements set by the chef.

In step A27, the restriction requirement data entered is matched with the data relating to menu selection for each menu.

Next, a description will be given of the abovementioned method of correcting the total cooking time P4 for use in calculating when to start preparation for cooking. As shown in FIG. 11 and FIGS. 15(*a*), 15(*b*), the total cooking time includes "heating time" and "standard preparation time" which are included in the print of bar code symbol 59 for each menu as P4*a* and P4*b*, respectively. The numerical value data items of the heating time and the standard preparation time read by the reader 31 are respectively stored at small addresses 40 and 50 in the data area [1] of the RAM 49 in the function unit 13 as seen in FIG. 15 (*a*).

With reference to the flow chart of FIG. 16, step S31 reads out the cooking frequency Cn of the first of the menus stored in the data area [3] of the RAM 51. In this step, the cooking frequency Cn of the menu not stored in the data area [3] is construed as 0.

For the menu read out in step S31, a correction parameter $\alpha$ for the preparation time relative to the cooking frequency Cn is read out from the data area [5] of ROM 46 in step S32.

In step S33, the "standard preparation time" P4*b* registered in the data area [1] of the RAM 49 is multiplied by the correction parameter $\alpha$ read out to obtain corrected "preparation time" $\alpha \cdot$P4*b*. To the corrected "preparation time" $\alpha \cdot$P4*b* is then added the "heating time" P4*a* to calculate the total cooking time $\overline{P4}$, which is thereafter stored at the pertinent small address 50 in the data area [2] of the RAM 49. Subsequently, the time to start preparation for cooking is calculated from the scheduled dinner start time entered as already stated (FIG. 14) and the total cooking time $\overline{P4}$ corrected as described above.

Figure 17A:
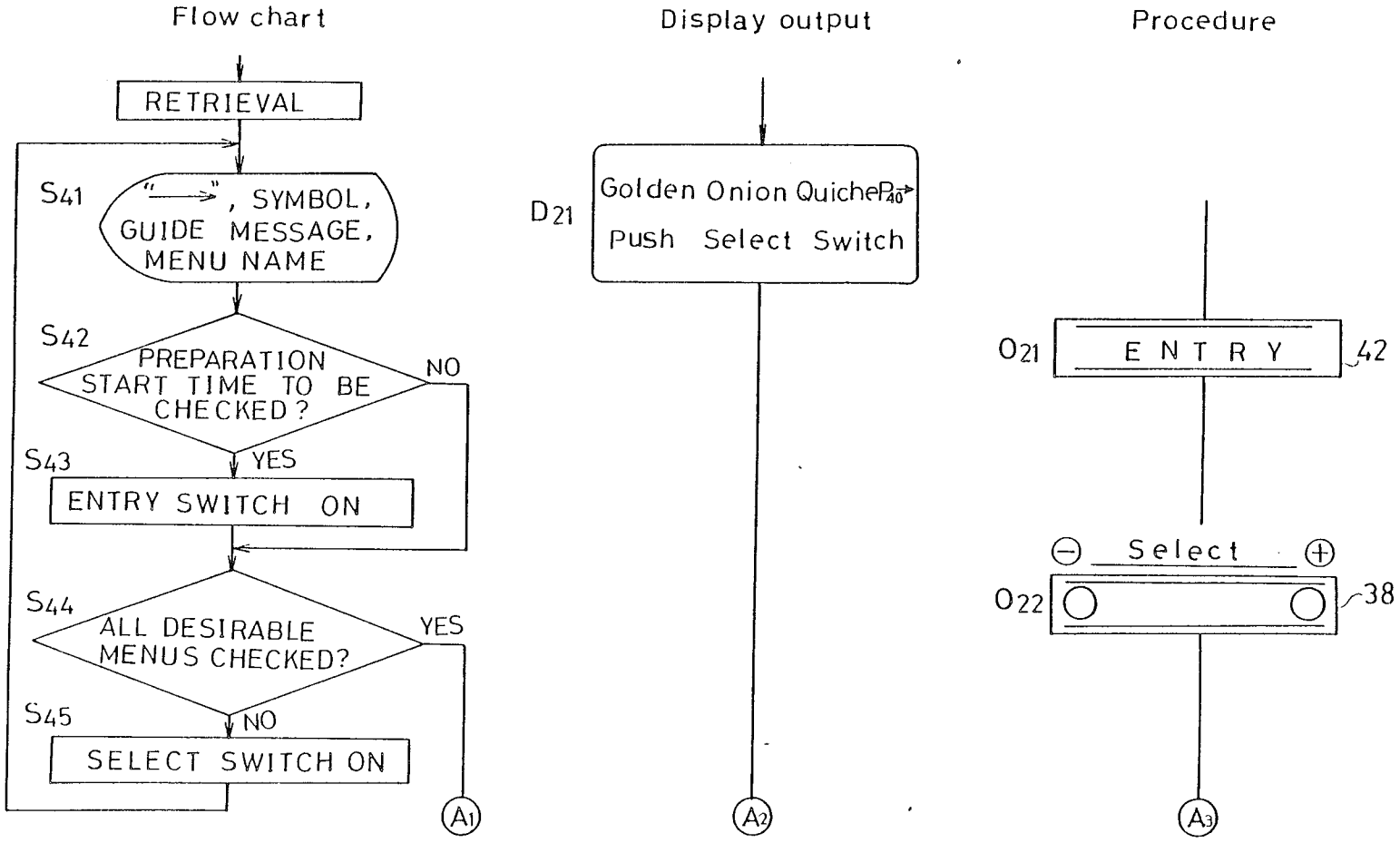
FIG. 17 (*a*) and FIG. 17 (*b*) are flow charts showing the process to be executed when the highest priority is given to when to start preparation for cooking, diagrams showing the procedure therefor and diagrams showing examples of presentations on the display.
Figure 17B:
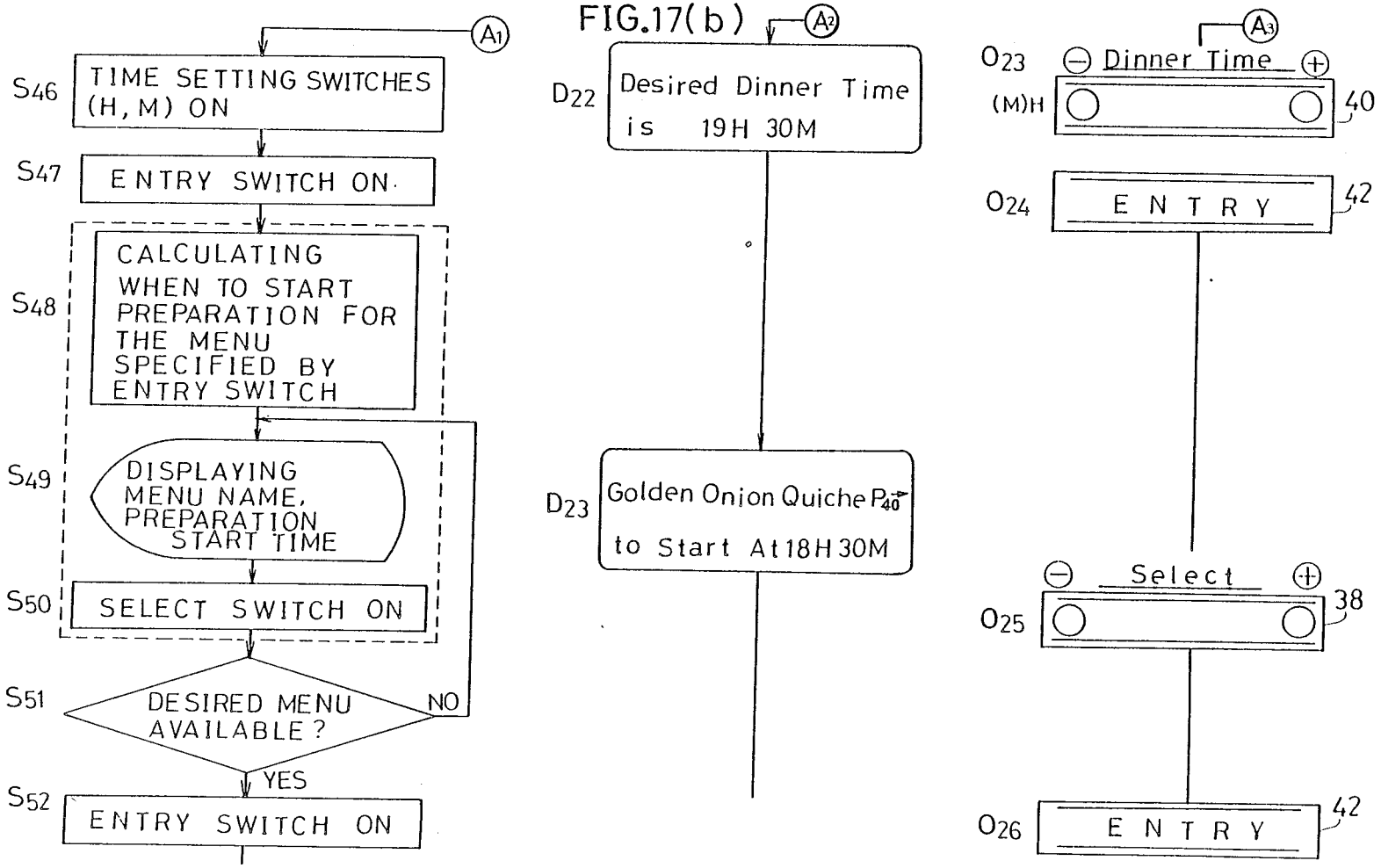

When the desired menu is to be selected with the highest priority given to dinner start time other than the foregoing four restriction requirements, the restriction requirements other than time restriction are entered for the retrieval of suitable menus, and the dinner start time is then set to determine the desired menu. This process will be described with reference to the flow charts of FIG. 17(*a*) and FIG. 17(*b*) show the procedure. FIGS. 17(*a*), 17(*b*) showing examples of presentations on the display 30. In setting the restriction requirements, the time restriction requirement is set at the fourth place of the priority order. Next, the restriction severity is set to "$\frac{3}{4}$" to exclude the time restriction requirement from the items to be compared for matching. Subsequently, a plurality of suitable menus are selected which fulfill the three restriction requirements. These suitable menus are then checked as to the time to start preparation for cooking, as will be described below.

In step S41, the name of one of the suitable menus, the page number concerned of the cookbook 54 and a guide message are presented on the display 30 as seen in display step D21.

When the cooker finds it necessary to check the displayed menu for the preparation start time in step S42, ENTRY switch 42 is depressed in step S43 (procedure step O21).

When it is found in step S44 that the chef has not checked all the suitable menus, the select switch 38 is depressed in step S45 (procedure step O22) to display the next menu. Steps S41 to S45 are repeated to completely check all the suitable menus, whereupon the sequence proceeds to step S46.

In step S46, the desired dinner start time is set in the same manner as already described (procedure step O23), whereupon the time setting is shown as seen in display step D22.

Depression of ENTRY switch 42 in step S47 (procedure step O24) is followed by step S48 to calculate when to start preparation for cooking the menu specified in step S43, in the manner already described.

In step S49, the display 30 shows the name of the first menu for which the preparation start time is calculated as above, the preparation start time and the page number concerned of the cookbook 54 as shown in display step D23.

In step S50, the select switch 38 is manipulated as already stated (procedure step O25). Thus, all the menus specified in step S43 are checked on the display 30 as to the preparation start time.

When the menu desirable to the cooker is found in step S51, ENTRY switch 42 is pushed in step S52 (procedure step O26) to eventually specify the desired menu.

The operation software of the foregoing embodiment may be replaced by other operation software insofar as it is possible for the chef to invalidate one or more restriction requirements of lower priority to select menus fulfilling the restriction requirements of higher priority when menus satisfying all the restriction requirements initially set by the chef are not available.

With the microwave oven of the invention described above, the desired menu fulfilling the restriction requirements contemplated by the chef can be selected by a simple procedure without necessitating any special skill or without entailing the burden that the chef must resort to the memory of cooking experience in the past. The function unit, which is removable from the oven main body, permits the user to select menus and enter cooking data at any desired place irrespective of the location of the oven.

Furthermore, the input means is so adapted that the desired priority order issettable by the chef at her will. When the input means is provided with means for specifying the number of restriction data items to be used in the priority order thus set and invalidating restriction data from item to item in an order reverse to the priority order, the priority order of restriction requirements can be changed with flexibility, for example, in conformity with a change in the environmental conditions of the chef.

The calculation-control means calculates when to start preparation for cooking, as corrected in accordance with the cooking frequency experienced, relative to the dinner start time and is provided with means for giving a signal indicating the preparation start time upon the arrival of the start time. Accordingly, by merely specifying the desired dinner time by a simple procedure, the cooker can start preparation for cooking without forgetting so as to be in time for the scheduled dinner time even if the time available for cooking is greatly limited.

What is claimed is:

1. A microwave oven comprising:

a main oven body having means for heating food items placed therein; and a function unit removably attached to a front portion of said main oven body, said function unit being operable at a location remote from said main oven body and including, optical read means for reading cooking data from bar codes provided for each of a plurality of menus assembled in a cookbook, input means for entering a plurality of cooking restriction data into said function unit, said cooking restriction data including heating temperatures for said microwave oven, desired caloric values for a selected menu, and maximum cooking times for the selected menu, memory means for storing said cooking data read by said optical read means and said plurality of cooking restriction data entered by said input means, control means for comparing said stored cooking data from each said plurality of menus read by said optical read means with said stored plurality of cooking restriction data and selecting at least one menu from said plurality of menus which meets cooking requirements identified by said stored plurality of cooking restriction data, and display means for displaying said cooking data read from said bar codes, said plurality of cooking restriction data entered by said input means, and said at least one menu selected by said control means, wherein said heating means is controlled according to said selected cooking data when said function unit is attached to said main oven body.

2. The microwave oven according to claim 1, wherein said input means includes means for setting a priority order for said plurality of cooking restriction data as determined by an operator of the microwave oven.

3. The microwave oven according to claim 2, wherein the input plurality of cooking restriction data may be invalidated for each item and selected in an order reverse to the priority order, said input means being further provided with means for specifying the number of items of restriction data to be invalidated.

4. The microwave oven according to claim 1, wherein said control means includes means for feeding to said display means a signal indicating heating progress during cooking when said function unit is attached to the front portion of said main oven body.

5. The microwave oven according to claim 1, wherein said control means includes means for selecting at least one menu fulfilling restriction requirements according to said cooking restriction data, calculating when to start preparation of a selected menu according to a heating time and standard preparation time included in the cooking data read from said bar code and producing a signal indicating a menu preparation start time upon arrival of said start time.

6. The microwave oven according to claim 5, wherein said control means includes means for correcting the standard preparation time using cooking frequency data retreived from said memory means and a correction parameter retrieved from said memory according to the cooking frequency data, and calculating the preparation start time according to a corrected result.

* * * * *